US007763804B2

(12) United States Patent
Runge

(10) Patent No.: US 7,763,804 B2
(45) Date of Patent: Jul. 27, 2010

(54) ELECTRICALLY CONDUCTIVE WIRE AND METHOD FOR ITS PRODUCTION

(75) Inventor: Joachim Runge, Bad Arolsen (DE)

(73) Assignee: Essex Europe (FR)

( * ) Notice: Subject to any disclaimer, the term of this patent is extended or adjusted under 35 U.S.C. 154(b) by 0 days.

(21) Appl. No.: 12/229,614

(22) Filed: Aug. 25, 2008

(65) Prior Publication Data

US 2009/0071689 A1 Mar. 19, 2009

(30) Foreign Application Priority Data

Aug. 31, 2007 (EP) ..... 07291061

(51) Int. Cl.
*H01B 7/00* (2006.01)

(52) U.S. Cl. ..... 174/110 R; 174/110 SR; 174/117 R; 174/117 F; 174/117 FF

(58) Field of Classification Search ..... 174/47, 174/70 C, 15.1, 15.2, 15.6, 15.7, 110 R, 113 R, 174/120 R, 122 R, 122 G, 117 R, 117 F, 117 FF
See application file for complete search history.

(56) References Cited

U.S. PATENT DOCUMENTS

| | | | | |
|---|---|---|---|---|
| 2,517,024 | A | 8/1950 | Presscott et al. | 432/72 |
| 2,658,742 | A | 11/1953 | Suter et al. | 432/72 |
| 4,294,952 | A * | 10/1981 | Mukoyama et al. | 528/67 |
| 4,321,426 | A * | 3/1982 | Schaeffer et al. | 174/34 |
| 4,609,702 | A * | 9/1986 | Zamek | 524/317 |
| 6,087,583 | A * | 7/2000 | Runge | 174/47 |
| 2004/0182596 | A1 * | 9/2004 | Sedlak | 174/120 R |

* cited by examiner

*Primary Examiner*—William H Mayo, III
(74) *Attorney, Agent, or Firm*—Sofer & Haroun, LLP

(57) ABSTRACT

An electrically conductive wire (1) is surrounded by a layer (3) which covers the same without any gaps and is composed of a crosslinked polymer material, over which a layer (6) composed of paper is arranged.

7 Claims, 1 Drawing Sheet

ELECTRICALLY CONDUCTIVE WIRE AND METHOD FOR ITS PRODUCTION

RELATED APPLICATION

This application claims the benefit of priority from European Patent Application No. 07 291 061.5, filed on Aug. 31, 2007, the entirety of which is incorporated by reference.

FIELD OF THE INVENTION

The invention relates to an electrically conductive wire which is surrounded by a layer composed of paper, for production of a winding which can be arranged in an electrical appliance and in which an oil which surrounds the winding and is used as a cooling medium is located, and to a method for production of the wire.

BACKGROUND

So-called twisted conductors, insulated with paper and with conductor elements composed of wires for electrical appliances that are operated in oil are known, in which the wires of the conductor elements are lacquered. By way of example, polyvinylacetal is used as a lacquer, and like other lacquers contains large amounts of solvent. A lacquer such as this is applied in a plurality of layers to the wire. It must then be burned in a special oven, during which process the solvent must be removed at the same time, in an environmentally friendly form. By way of example, DE-PS 1 242 511 describes one oven which can be used for this purpose. The application of the lacquer with the subsequent processes of burning in and solvent removal is complex, and is restricted to wires with relatively small dimensions.

By way of example, a wire as described initially is used as a flat wire with a rectangular cross section in order to produce windings for transformers and electrical machines. According to the prior art, which has been known very many years, the wire is surrounded by a layer composed of paper as insulation, which is also used as a spacer from adjacent turns of the wire arranged in a winding. The production of a wire such as this and of a winding manufactured from it is considerably simpler than the wire described above. However, in practice, it has been found that a wire such as this is not corrosion-resistant in the long term. In fact, conductive copper sulphide is formed by corrosive components of the oil used as coolant during use of an electrical appliance equipped with a wire such as this, damaging the layer composed of paper. A correspondingly constructed winding then rapidly becomes unusable, so that the associated appliance no longer operates.

OBJECTS AND SUMMARY

The invention is based on the object of designing the wire as described initially such that it is more resistant to corrosion while being simpler to manufacture.

According to the invention, this object is achieved in that the wire is surrounded by a layer which covers the same without any gaps and is composed of a crosslinked polymer material, over which the layer composed of paper is arranged.

The polymer material can be applied directly to the wire using normal methods and apparatus for lacquering, and can then be crosslinked, to be precise even on relatively large-dimension conductors. The layer composed of paper can then be formed around the wire using a normal technique. A polymer material such as this contains only a relatively small amount of solvent so that no complex subsequent treatment is required.

For the material, this is true even when it is applied to a strip composed of paper, which is then wound around the wire such that the polymer material surrounds the wire without any gaps, resting on the wire. In addition, the polymer material is resistant in the long term to commercially available oils, as a result of which windings constructed using the same for appliances cooled with oil have a considerably longer life.

BRIEF DESCRIPTION OF THE DRAWINGS

The subject matter of the invention will be explained using exemplary embodiments and with reference to the drawings, in which.

DETAILED DESCRIPTION

Figure 1:
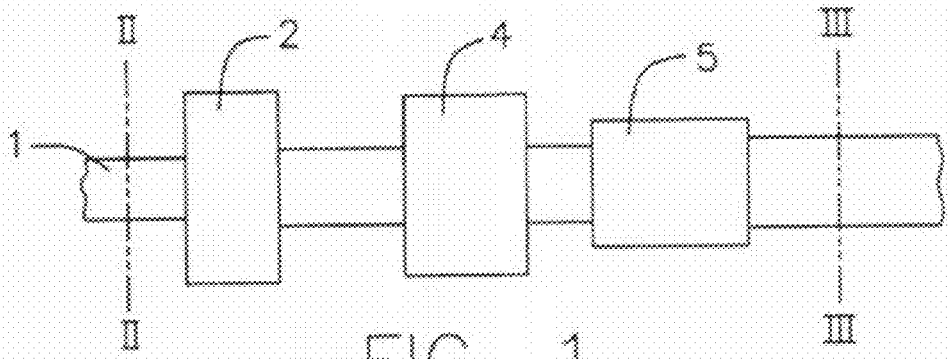
FIG. 1 shows a schematic illustration of an arrangement for production of a wire according to the invention.
Figure 2:
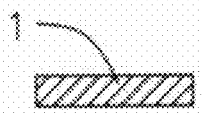
FIG. 2 shows a section through FIG. 1 along the line II-II, in the form of an enlarged illustration.
Figure 3:
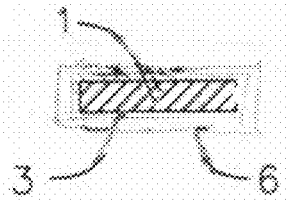
FIG. 3 shows a section through FIG. 1 along the line III-III, in the form of an enlarged illustration.
Figure 4:
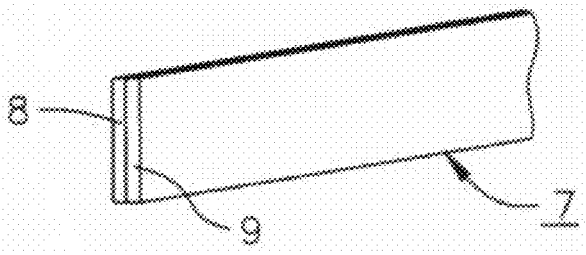
FIG. 4 shows a strip which can be used for winding around a wire.

A first variant of a wire according to the invention, for example, is produced as follows:

A layer 3 (FIG. 3) composed of a polymer material which can be crosslinked is applied all round, in a coating apparatus 2, to a prefabricated flat wire 1 with a rectangular cross section (FIG. 2) and preferably composed of copper, to be precise in at least one layer element. The layer 3 is advantageously composed of two layer elements of the polymer material, which are each applied successively to the wire 1, with a thickness, for example, of 0.01 mm. The coating apparatus 2 may be a normal apparatus for lacquering.

The wire 1 that has been coated in this way is then passed to a crosslinking device 4 in which the polymer material is crosslinked by supplying heat. Depending on the dimensions and the cross section of the wire 1, the crosslinking is carried out, for example, at a temperature between 300° C. and 350° C. The layer 3 then adheres firmly to the wire 1. Finally, a layer 6 composed of paper is formed around the wire 1 in an apparatus 5. By way of example, a strip composed of commercially available insulating paper can be wound around the wire 1 for this purpose.

An epoxy resin is particularly suitable as the polymer material. Alkyl resins or polyester imides, in a modified form as well, can also be used.

In a second variant for production of the wire according to the invention, a strip 7 can be used which comprises a paper strip 9 which, preferably on one side, is provided over its entire surface with a layer 8 composed of a polymer material. In principle it would also be possible to coat the strip 7 with polymer material on both sides. The polymer material may be the same as stated above. Once again, the paper strip 9 may be composed of commercially available insulating paper. This variant further simplifies the production of the wire since both layers—polymer material on the one hand and paper on the other hand—are applied to the wire 1 in just one process.

Figure 5:
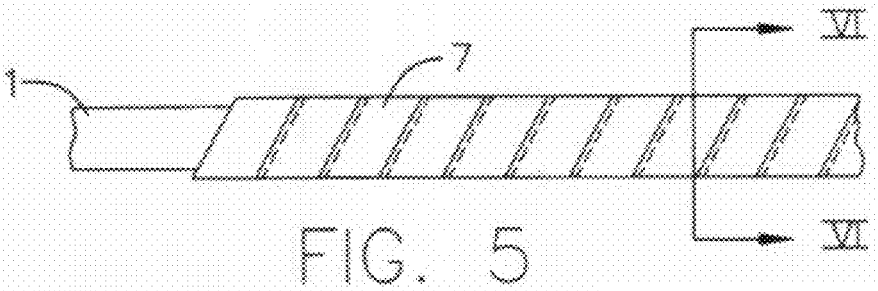
FIG. 5 shows a wire with a strip wound around it.
Figure 6:
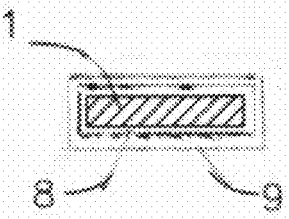
FIG. 6 shows a section through FIG. 5 along the line VI-VI, in the form of an enlarged illustration.

The strip 7 is wound around the wire 1 such that a layer 8, which corresponds to the layer 3, surrounds the wire 1 without any gaps and is composed of polymer material, is produced. For this purpose, the strip 7 can be wound around the wire 1 in an abutting form. However, in one preferred embodiment, it is wound around the wire 1 with an overlap. This is indicated by dashed lines in FIG. 5.

The polymer material may finally be crosslinked in this variant of the production of the wire as well. However, this step can also be dispensed with because windings composed of a wire such as this are dried by heating after their manufacture, at temperatures which are also adequate for crosslinking of the polymer material.

The invention claimed is:

1. Electrically conductive wire which is surrounded by a layer composed of paper, for production of a winding which can be arranged in an electrical appliance and in which an oil which surrounds the winding and is used as a cooling medium is located, said electrically conductive wire comprising:

a wire, surrounded by a layer which covers the same without any gaps and is composed of a crosslinked polymer material; and a layer composed of paper is arranged over the layer composed of crosslinked polymer-material.

2. Wire according to claim 1, wherein the wire is surrounded by a strip composed of paper which is provided on one side with a layer composed of the polymer material, and which paper has a layer composed of the polymer material which rests on the wire and is wound around it.

3. Wire according to claim 2, wherein epoxy resin is used as the polymer material.

4. Wire according to claims 2, wherein a modified alkyl resin or a modified polyester imide is used as a polymer material.

5. Method for production of a wire according to claim 1, wherein a layer composed of a polymer material which can he crosslinked is applied in at least one layer element to the wire in a coating apparatus, and the polymer material is then crosslinked by supplying heat, and in that the layer composed of paper is then applied.

6. Method for production of a wire according to claim 1, wherein a strip composed of a paper which is provided at least on one side with a layer composed of polymer material is wound around the wire such that the polymer material rests on the wire.

7. Wire according to claim 6, wherein the strip is wound around the wire with an overlap.

* * * * *